US006626104B2

(12) United States Patent
Albus et al.

(10) Patent No.: US 6,626,104 B2
(45) Date of Patent: Sep. 30, 2003

(54) OFFSET PRINTING MACHINE WITH A REGISTER CONTROL AND METHOD FOR OPERATING SAID MACHINE

(75) Inventors: Matthias Albus, Unterschleissheim (DE); Martin Endisch, Wertingen (DE)

(73) Assignee: Man Roland Druckmaschinen AG, Offenbach am Main (DE)

( * ) Notice: Subject to any disclaimer, the term of this patent is extended or adjusted under 35 U.S.C. 154(b) by 99 days.

(21) Appl. No.: 09/784,657

(22) Filed: Feb. 15, 2001

(65) Prior Publication Data

US 2001/0045166 A1 Nov. 29, 2001

(30) Foreign Application Priority Data

Feb. 15, 2000 (DE) ..... 100 06 722

(51) Int. Cl.[7] ..... B41M 1/14

(52) U.S. Cl. ..... 101/248; 101/181; 101/485; 101/211

(58) Field of Search ..... 101/180, 181, 101/182, 183, 211, 248, 481, 485

(56) References Cited

U.S. PATENT DOCUMENTS 4,273,045 A * 6/1981 Crowley ..... 101/181
4,534,288 A * 8/1985 Brovman ..... 101/181
4,932,320 A * 6/1990 Brunetti et al. ..... 101/181
4,953,461 A 9/1990 Gaffney et al. ..... 101/142
5,056,430 A * 10/1991 Bayerlein et al. ..... 101/181
5,159,878 A 11/1992 Donelan et al. ..... 101/217
5,245,923 A 9/1993 Vrotacoe ..... 101/217
5,351,616 A * 10/1994 Gelinas et al. ..... 101/218
5,974,967 A * 11/1999 Bravenec et al. ..... 101/183
6,085,651 A * 7/2000 Defrance et al. ..... 101/182
6,129,015 A * 10/2000 Dewey ..... 101/183
6,244,174 B1 * 6/2001 Sirowitzki et al. ..... 101/212
6,357,354 B1 * 3/2002 Dauer et al. ..... 101/375

* cited by examiner

*Primary Examiner*—Leslie J. Evanisko
*Assistant Examiner*—Kevin D. Williams
(74) *Attorney, Agent, or Firm*—Cohen, Pontani, Lieberman & Pavane

(57) ABSTRACT

At specific time intervals register commands are fed to a plate cylinder in a printing machine in the circumferential direction and/or the lateral direction and adjust the cylinder by a small amount. All the remaining plate cylinders can be readjusted with the aid of the register control. Alternatively, the same control commands may also be fed to all the plate cylinders involved in printing, in order to carry out a desired continuous or stepwise adjustment of the cylinders in the lateral direction and/or the circumferential direction.

9 Claims, 2 Drawing Sheets

OFFSET PRINTING MACHINE WITH A REGISTER CONTROL AND METHOD FOR OPERATING SAID MACHINE

BACKGROUND OF THE INVENTION

1. Field of the Invention

The invention relates to an offset printing machine, in particular a web-fed rotary offset printing machine, with one or more printing units arranged one behind the other in the direction of transport of the print carrier web for printing the web on both sides with one or more colors. Each printing unit includes a plate cylinder and a blanket cylinder on each side of the web. Each plate cylinder carries a finite or sleeve-shaped printing plate, and each blanket cylinder carries a finite or sleeve-shaped rubber blanket arranged for transfer of ink from the corresponding printing plate. The invention further relates to a method for operating such an offset printing machine.

2. Description of the Related Art

It is already known from U.S. Pat. No. 4,953,461 to change the circumferential speed between the plate cylinder and rubber-blanket cylinder in order to eliminate the so-called ink build-up (piling) in offset printing machines, so that, whenever the plate cylinder rotates during the printing operation, the image is transferred from the printing plate onto the rubber blanket at a different location, these changes being so slight that they have either no effect or only an acceptable or insignificant effect on the printed product. Furthermore, it is known from U.S. Pat. No. 5,245,923, likewise for the purpose of avoiding an ink build-up, to cause the rubber sleeve arranged on the rubber-blanket cylinder to creep, that is to say "slip", on the rubber-blanket cylinder, so that the printing plate or printing sleeve on the plate cylinder likewise transfers the inked printing image on the surface of the rubber blanket at different locations, so that an accumulation of ink during printing is avoided. On the one hand, it is scarcely possible for a controlled creeping of the rubber-blanket sleeve on the rubber-blanket cylinder to be carried out and, on the other hand, a variation in the creep or in the extent of the creep on the rubber-blanket cylinder is not possible during printing.

The known measures described above therefore eliminate only the adverse effect of the so-called ink build-up on the rubber blanket on the printing image applied by the latter. As a rule, the quality of the image to be printed is impaired unacceptably only when a considerable ink amount has "built up", that is to say accumulated. In this case, an interruption in the printing operation is also often advisable, in order to wash the rubber blanket having the ink build-up or all the rubber-blanket cylinders involved in printing. If an appropriately large number of printed copies have then already been printed, this does not have an excessively disruptive or adverse effect.

It is also generally known, however, that, in offset printing machines, in particular web-fed rotary offset printing machines operating on the blanket-to-blanket principle, that is to say so-called illustration printing machines with horizontal web guidance, particularly during the printing of high-grade papers, that is to say, for example, coated or calendered papers, even after only a few thousand printed copies a kind of rubber-blanket ink build-up occurs, which makes it necessary to wash the rubber blanket even after such a short operating period. Various measures for eliminating this effect have not hitherto been entirely successful.

In particular, so-called light screens, that is to say screens with relatively few or small screen dots per unit area, react particularly sensitively to this specific rubber-blanket ink build-up, to be precise on the rear side of the sheet or web, that is to say the ink transfer behavior changes in these screen surfaces as a result of a build-up on the rubber blanket on the other side of the sheet or web. In other words, for example when ink builds up on the rubber-blanket cylinder arranged below the horizontally guided print carrier web, on the top side of the web or in the printing image applied to the latter by the upper rubber-blanket cylinder the quality of the printing image is influenced adversely, this also being known as reverse piling".

As an initial finding for the invention described below, it was established, for the first time, that the above-described quality fault in the printing image becomes noticeable at that point, that is to say on the rubber-blanket cylinder, where the web last comes loose from the rubber-blanket cylinder. As is generally known, normally, the rubber-blanket and plate cylinders lying in one plane are positioned slightly obliquely, so as to result in a partial looping of the web around one of the rubber-blanket cylinders. Alternatively, this partial looping of the print carrier web around one of the cylinders may also be achieved by the rubber-blanket cylinders located one above the other being offset slightly in a suitable way.

Proceeding from this, the object of the present invention, in offset printing machines, in particular in web-fed rotary offset printing machines operating on the blanket-to-blanket principle, is to provide a way to delay or prevent the disturbing premature ink build-up.

SUMMARY OF THE INVENTION

According to the invention, the rubber blanket cannot undergo any movement relative to the rubber blanket cylinder. A lateral register is arranged to move each plate cylinder axially with respect to the corresponding blanket cylinder, and a circumferential register is arranged to move each said plate cylinder circumferentially with respect to the corresponding blanket cylinder.

Either the lateral registers or the circumferential registers, or both, are adjustable by predetermined values either at predetermined time intervals or continuously. The corresponding plate cylinders are displaceable in either the axial or circumferential directions, or both, by an amount corresponding to the corresponding predetermined values.

In the method according to the invention, commands are fed to either of the registers, or both, for at least one of lateral and circumferential displacement of the corresponding plate cylinder by predetermined amounts at predetermined time intervals or continuously.

The various features of novelty which characterize the invention are pointed out with particularity in the claims annexed to and forming a part of the disclosure. For a better understanding of the invention, its operating advantages, and specific objects attained by its use, reference should be had to the drawing and descriptive matter in which there are illustrated and described preferred embodiments of the invention.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

DETAILED DESCRIPTION OF THE PRESENTLY PREFERRED EMBODIMENTS

Figure 1:
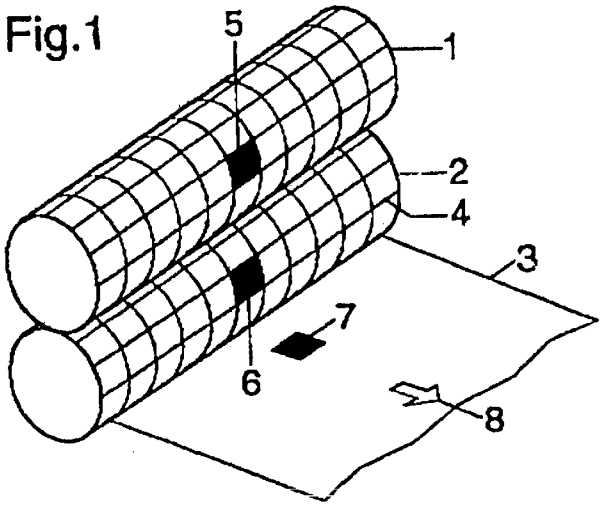
FIG. 1 is a diagrammatic perspective showing a pair of plate and rubber-blanket cylinders which is arranged above a paper web.
Figure 4:
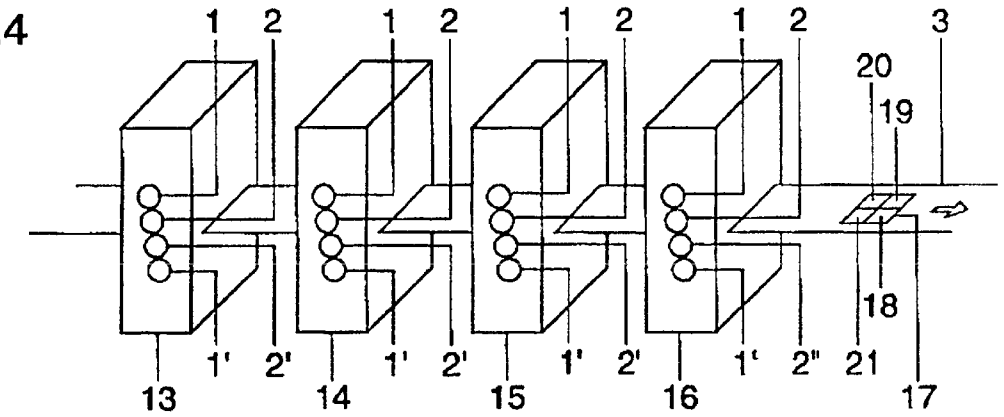
FIG. 4 is a diagrammatic perspective showing a printing machine consisting of four printing units.

As already stated, the invention described below may be used particularly advantageously on so-called blanket-to-blanket machines, in which, in each printing unit, a pair of plate and rubber-blanket cylinders is arranged for printing the top side of a print carrier web guided horizontally through the machines and, in each printing unit, a lower pair of plate and rubber-blanket cylinders is arranged for printing the underside. FIG. 1 illustrates such a pair of plate and rubber-blanket cylinders, the plate cylinder 1 being assigned a rubber-blanket cylinder 2 which is arranged above the horizontally guided print carrier web 3. In this respect, FIG. 4 shows a web-fed rotary offset printing machine which consists of four printing units 13, 14, 15, 16 and in which each printing unit can apply an ink to the top side and to the underside of the print carrier web 3 which is moved in the direction of an arrow 8.

For example, black ink can be applied by means of the printing unit 13, cyan by means of the printing unit 14, magenta by means of the printing unit 15 and yellow by means of the printing unit 16, so that the machine may be referred to as a four-color machine, in which in each case the print carrier web 3 runs through two rubber-blanket cylinders. In FIG. 4, the lower pairs of plate and rubber-blanket cylinders are designated in each case by 1' and 2'.

It is a precondition for applying the invention described here that a rubber blanket 4 arranged on the rubber-blanket cylinder 2 cannot be displaced circumferentially on the rubber-blanket cylinder 2 during the printing operation. When a conventional finite rubber blanket is used, where its ends are fixed in an axially running cylinder gap, this in any case usually does not occur, and when sleeve-shaped, that is to say endless rubber blankets are used, the sleeves must be fixed securely in terms of rotation on the rubber-blanket cylinder, so that they cannot creep, that is to say cannot be displaced in the circumferential direction during printing.

It is possible, within the scope of the invention, that the associated plate cylinder 1 can likewise have an endless printing-plate sleeve, or it is also possible to use a finite printing plate, the start and end of which are fixed in a gap running axially through the plate cylinder 1. This applies both to the pairs of plate and rubber-blanket cylinders 1, 2 and to the pairs of plate and rubber-blanket cylinders 1', 2' arranged below the print carrier web 3.

In order to explain the invention, it is necessary to start from an initial position, usually at the commencement of a printing operation, in which a point to be printed or an ink location, here referred to as a screen dot 5, is applied. During the rolling of the plate cylinder 1 on the rubber-blanket cylinder 2, the ink is transferred to a corresponding location, here the screen dot 6 on the rubber-blanket cylinder. This screen dot 6 is applied from the rubber-blanket cylinder 2 onto the print carrier web 3 as screen dot 7.

When the pair of plate and rubber-blanket cylinders 1, 2 or 1', 2' illustrated in FIG. 1 is arranged in the printing unit 13 (FIG. 4), a first ink can thereby be applied. As a rule, this is black ink. In the subsequent printing units 14, 15 and 16, the screen dots corresponding to the image to be printed for the inks printed on in these printing units are applied to the print carrier web 3 and must be in an exact relationship to one another so that a high-quality print can be obtained. The various printing inks, that is to say the screen dots, must in each case be applied in register to the top side and also to the underside of the print carrier web. As is generally known, in the event of deviations in the exact position of the individual screen dots, the plate cylinders 1 or 1' in the respective printing unit are adjusted by means of the lateral register control in the axial direction (lateral register) and the circumferential register control in the circumferential direction (circumferential register), until the individual ink dots (screen) are printed exactly next to one another or until the desired register is reached.

Figure 3:
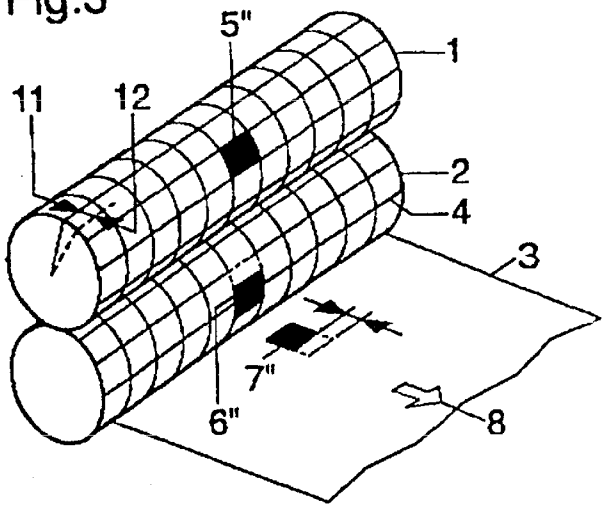
FIG. 3 is a diagrammatic perspective showing the pair of plate and rubber-blanket cylinders after circumferential register control.
Figure 2:
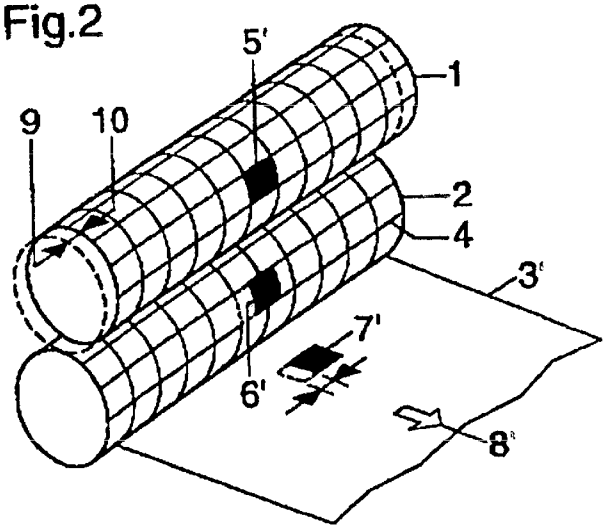
FIG. 2 is a diagrammatic perspective showing the pair of plate and rubber-blanket cylinders after axial register control.

In FIG. 2, the arrows 9 and 10 indicate how a plate cylinder 1 is displaced axially in relation to a rubber-blanket cylinder 2, so that the local position of the screen dot 5 of FIG. 1 is displaced into the position 5' and therefore the position 6' is also displaced on the rubber-blanket cylinder 2, and ultimately the screen dot on the print carrier web 3, as indicated at 7' (represented by solid and broken lines as a rectangle). In a similar way to this, FIG. 3 shows the possibility of displacing the screen dot in the circumferential direction of the cylinder or the longitudinal direction of the print carrier web 3, by the circumferential register being activated. The arrows 11 and 12 indicate a rotation of the plate cylinder 1, to be precise in the circumferential direction, so that the screen dot 5 shown in FIG. 1 is displaced in the circumferential direction of the plate cylinder and also in the circumferential direction of the rubber-blanket cylinder, with the result that the screen dot 7" on the print carrier web 3 in FIG. 3 changes in the longitudinal direction of the print carrier web 3, whilst, in relation to the screen dot 7' according to FIG. 2, it has been displaced transversely to the direction of run of the print carrier web 3.

In a similar way to this, the pairs of plate and rubber-blanket cylinders 1', 2' below the print carrier web (FIG. 4) are displaced circumferentially and/or laterally, in order to set the printing inks (register) in relation to one another. Register controls of this kind have been known for a long time and are used virtually in every printing machine.

The basic concept of the invention is that the ink fault (reverse piling) on one side of the print carrier web as a result of the ink build-up on the other side is reduced or eliminated, in that the plate cylinder assigned to the rubber-blanket cylinder on which ink builds up is continuously or briefly rotated and/or laterally displaced either in the axial direction and/or in the circumferential direction. To be precise, the plate cylinder is displaced by an amount which does not impair the quality of the printing image, that is to say circumferential register or lateral register displacement without any noticeable harmful consequences as regards quality. Both measures may, of course, also be used simultaneously.

A further highly essential basic principle of the invention is that prophylactically, that is to say in a preventive way, all the plate cylinders 1 on the top side of the print carrier web and/or all the plate cylinders 1' below the print carrier web are in each case circumferentially and/or axially displaced by a small amount continuously or at intervals with the aid of the circumferential register and/or the lateral register respectively.

A further basic principle of the invention is that one of the plate cylinders in the printing machine according to FIG. 4 is displaced axially by a specific amount and/or circumferentially by a specific amount, to be precise either continuously or in each case in specific time segments, and that, as a result of the side register control and/or circumferential register control present in the machine, the remaining plate cylinders are automatically readjusted, until the necessary register is obtained both on the underside and (if desired) correspondingly on the top side of the print carrier web, that is to say until the ink (screen dots) is applied in an exact position to the print carrier web 3.

Furthermore, a fundamental principle of the invention is that, proceeding from the use of finite printing plates, that is to say plates with a start and an end which are fixed in an axial plate-cylinder gap, the plate cylinders are displaced by a specific amount from an initial position (screen dot 5 in FIG. 1) in the axial direction, for example to the right in FIG. 2 (5'), and that, after a further time segment or continuously, the plate cylinder 1 or 1' is displaced (not illustrated), preferably by the same amount, in the opposite direction, that is to say to the left from the starting point of the screen dot 5, after which the reversal takes place once again, so that the initial position according to FIG. 1 is preferably assumed again. The lateral and circumferential displacement, starting from the neutral position according to FIG. 1, to the right is shown in FIGS. 2 and 3 and in the circumferential direction according to FIG. 3.

As stated, subsequently or in subsequent time segments or intervals, the plate cylinder 1 is in each case displaced to the left with respect to the initial position in FIG. 1, so that, in FIGS. 2 and 3, the screen dots 5' and 5" come to rest on the left of the screen dots 6' and 6".

A further essential principle of the invention is that, for example, starting from the neutral position in FIG. 1, the lateral register adjustment, that is to say the axial displacement according to FIG. 2, is carried out in a plurality of steps to the right, after which the plate cylinder 1 is likewise displaced in the opposite direction in a plurality of steps, to be precise as far as the initial position (screen dot 5 in FIG. 1), and then, starting from the initial position, to the left, this not being illustrated in FIG. 2. In principle, this is also possible in a similar way with regard to the circumferential register (FIG. 3).

As already stated, the stepwise displacement in both the axial and the circumferential direction may be carried out by one of the plate cylinders being displaced in this way, for example the plate cylinder 1 in the printing unit 15, which is then designated as the master cylinder, after which the remaining plate cylinders 1 in the printing units 13, 14, 16 are always automatically readjusted by means of the existing register control, this also applying to the cylinders 1' arranged below the print carrier web 3. All the plate cylinders 1 and 1' may likewise be changed axially and circumferentially by predetermined amounts stepwise or continuously.

Figure 7:
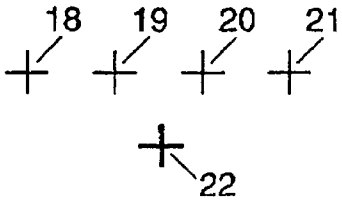
FIG. 7 shows register crosses, also known as locating crosses.
Figure 5A:
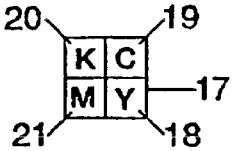
FIGS. 5*a* to 5*c* show register settings according to a first method.
Figure 5B:
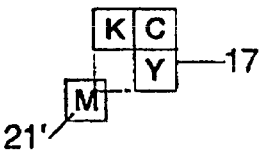
Figure 5C:
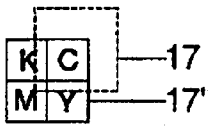

FIG. 5*a* shows diagrammatically four screen dots 18, 19, 20, 21 located next to one another for the four colors in an exact initial state, that is to say in-register, as they can be seen and measured after running through the printing units 13, 14, 15, 16 in a so-called checking zone 17 for colour registers. FIG. 7 also shows diagrammatically the possibility that a so-called register cross is printed onto the print carrier web 3 by means of each ink, this being indicated by crosses 18, 19, 20, 21. When the color register is in order, for example in upper images, the screen dots are located exactly next to one another, as can be seen in FIG. 5*a,* and, according to FIG. 7, all the register crosses 18, 19, 20, 21 are in congruence, so that only a single, usually a thicker register cross 22 can be seen on the print carrier web 3. Deviations in the register cross or screen lead to controls, such as are described below with the aid of FIGS. 5*b* and 5*c*. FIG. 5*b* shows how the checking zone 17 changes as a result of an adjustment of, for example, the master plate cylinder, after which the remaining screen dots in the checking zone 17 are automatically readjusted by means of the color register control to assume the checking zone position 17' according to FIG. 5*c,* that is to say the register is in order again in FIG. 5*c*.

Figure 6A:
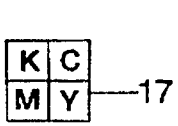
FIGS. 6*a* and 6*b* show register settings according to a second method.
Figure 6B:
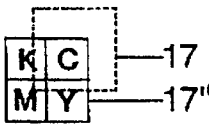

Alternatively, FIG. 6*a* and FIG. 6*b* show advantageously how the screen dots of all four colours are simultaneously displaced from the checking zone position 17 (FIG. 6*a*) to the checking zone position 17" as a result of a joint displacement and/or rotation of all the upper plate cylinders 1 or all the lower plate cylinders 1'. In this case, the register control does not have to be activated, since all the plate cylinders 1 or 1' receive a specific command, whereby they are all simultaneously adjusted by a specific amount or displaced continuously by a specific amount in the circumferential direction and/or lateral direction, which, as stated, may also in each case take place in steps in one direction, even before reversal is carried out, after which the register can be displaced once more in steps in the other direction in specific time segments.

In an advantageous exemplary embodiment, the side register is adjusted by +0.03 mm either in a single step or in a plurality of steps at intervals, to be precise proceeding from a starting position, such as is illustrated, for example, in FIG. 1 and FIGS. 5*a* and 6*a*. After 2 minutes, the circumferential register can be adjusted by +0.03 mm, and, after a further 2 minutes, the side register can be adjusted by −0.03 mm, and, after a further two minutes, the circumferential register by −0.03 mm. These four steps may then be repeated, to be precise, advantageously, during the entire printing operation. The adjusting operation, that is to say the frequency and extent, depends on the intensity of the backside piling. The more pronounced the phenomenon is, the shorter become the time intervals between which individual register settings must be carried out. The size of the adjustment travel also depends on the intensity of the problem, that is to say also on the so-called screen width. The greater the screen width is, the greater the adjustment travel of the individual steps may also be. These are findings which are essential to the invention.

Advantageously, the control may be carried out by the operator via the machine desk or it can take place automatically with the aid of a menu. With the aid of the control stand of the machine or of the menu provided in this, the step width of the individual register adjustment and the time until the next register adjustment can be pre-selected by the operator and be enabled and stopped for each procedure.

The invention is not limited by the embodiments described above which are presented as examples only but can be modified in various ways within the scope of protection defined by the appended patent claims.

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

We claim:

1. An offset printing machine comprising at least one printing unit for printing a print carrier web on both sides with at least one color, said at least one unit comprising:

a plate cylinder arranged on each side of the web, each said plate cylinder carrying a finite printing plate;

a rubber blanket cylinder arranged on each side of the web, each said rubber blanket cylinder carrying a rubber sleeve which cannot undergo any movement relative to the rubber blanket cylinder, each said rubber blanket cylinder being arranged for transfer of ink from a corresponding said printing plate;

a lateral register arranged to move each said plate cylinder axially with respect to the corresponding blanket cylinder;

a circumferential register arranged to move each said plate cylinder circumferentially with respect to the corresponding blanket cylinder;

one of the lateral registers and the circumferential registers being adjustable on command by predetermined values at one of predetermined time intervals and continuously, the corresponding plate cylinders being displaceable in at least one of the axial and circumferential direction by an amount corresponding to the corresponding predetermined values;

wherein, at predetermined time intervals, one said plate cylinder can be at least one of rotated forwards and backwards and displaced back and forth axially by predetermined amounts on command, and wherein the remaining plate cylinders involved in printing follow the movement of the one plate cylinder automatically by means of circumferential and lateral register control.

2. Offset printing machine according to claim 1, wherein the plate cylinders can be at least one of rotated and displaced continuously by predetermined amounts during the printing operation.

3. Offset printing machine according to claim 1 wherein the rotation and axial displacement of the plate cylinders in the respective direction consists of a plurality of segments offset in time.

4. Offset printing machine as in claim 1 comprising a plurality of said printing units arranged one behind the other in the direction of transport of the print carrier web, for printing the web on both sides with a plurality of colors.

5. Method for operating an offset rotary printing machine of the type comprising at least one printing unit, said at least one printing unit comprising a printing plate cylinder and a rubber blanket cylinder arranged on each side of a web for printing the web on both sides, a lateral register arranged to adjust the axial position of each said printing plate cylinder relative to the corresponding blanket cylinder, and a circumferential register arranged to adjust the circumferential position of each said printing plate cylinder relative to the corresponding blanket cylinder, said method comprising feeding commands to at least one of said registers for at least one of lateral and circumferential displacement of one of said plate cylinders by predetermined amounts at predetermined time intervals, the remaining plate cylinders involved in printing following the movement of the one plate cylinder automatically by means of circumferential and lateral register control.

6. Method as in claim 5 comprising feeding commands to both of said registers for both lateral and axial displacement of said plate cylinder relative to the corresponding blanket cylinder by predetermined amounts at predetermined time intervals.

7. Method as in claim 5 wherein said commands are controlled manually from a control desk of the printing machine.

8. Method as in claim 5 wherein said commands are controlled by a predetermined control program in the form of a menu.

9. An offset printing machine comprising at least one printing unit for printing a print carrier web on both sides with at least one color, said at least one unit comprising a plate cylinder arranged on each side of the web, each said plate cylinder carrying a finite printing plate;

a rubber blanket cylinder arranged on each side of the web, each said rubber blanket cylinder carrying a rubber sleeve which cannot undergo any movement relative to the rubber blanket cylinder, each said rubber blanket cylinder being arranged for transfer of ink from a corresponding said printing plate;

a lateral register arranged to move each said plate cylinder axially with respect to the corresponding blanket cylinder;

a circumferential register arranged to move each said plate cylinder circumferentially with respect to the corresponding blanket cylinder;

one of the lateral registers and the circumferential registers being adjustable on command by predetermined values at one of predetermined time intervals and continuously, the corresponding plate cylinders being displaceable in at least one of the axial and circumferential direction by an amount corresponding to the corresponding predetermined values;

wherein, at predetermined time intervals, one of said plate cylinders can be at least one of rotated in a first direction and moved back and forth in the axial direction by predetermined amounts on command, and wherein the remaining cylinders involved in printing follow the movements of the one plate cylinder automatically by means of circumferential and lateral register control.

* * * * *